US011619143B2

(12) United States Patent
Iwata

(10) Patent No.: US 11,619,143 B2
(45) Date of Patent: Apr. 4, 2023

(54) GAS EXPANDER

(71) Applicant: MITSUBISHI HEAVY INDUSTRIES COMPRESSOR CORPORATION, Tokyo (JP)

(72) Inventor: Fumihiko Iwata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/649,602

(22) Filed: Feb. 1, 2022

(65) Prior Publication Data

US 2022/0260088 A1 Aug. 18, 2022

(30) Foreign Application Priority Data

Feb. 18, 2021 (JP) ..... JP2021-024191

(51) Int. Cl.
*F01D 25/30* (2006.01)

(52) U.S. Cl.
CPC ..... *F01D 25/30* (2013.01); *F05D 2240/12* (2013.01)

(58) Field of Classification Search
CPC ..... F01D 25/30
See application file for complete search history.

(56) References Cited

U.S. PATENT DOCUMENTS 3,182,748 A * 5/1965 Wirt ..... F04D 29/661 96/385
3,994,620 A * 11/1976 Spraker, Jr. ..... F01D 17/105 415/157
5,338,155 A * 8/1994 Kreitmeier ..... F01D 25/30 415/211.2
5,791,136 A * 8/1998 Utamura ..... F01D 25/30 60/39.5
6,866,479 B2 * 3/2005 Ishizaka ..... F01D 25/30 415/209.1
9,494,053 B2 * 11/2016 Orosa ..... F01D 17/143
10,087,824 B2 * 10/2018 Wilkins ..... F02B 37/18
2015/0167693 A1 * 6/2015 Yamasaki ..... F01D 25/30 415/211.2
2016/0245119 A1 8/2016 Wilkins et al.
2018/0320546 A1 * 11/2018 Yonemura ..... F01D 25/04

FOREIGN PATENT DOCUMENTS

CN 105909319 B 9/2020
JP 2016-003584 A 1/2016
WO 2017-138035 A1 8/2017

* cited by examiner

*Primary Examiner* — Justin D Seabe
(74) *Attorney, Agent, or Firm* — Osha Bergman Watanabe & Burton LLP

(57) ABSTRACT

A gas expander includes a scroll casing, an impeller accommodated in the scroll casing and rotationally driven to a first side in a circumferential direction around a central axis by the gas flowing while expanding from an outside to an inside in a radial direction, a diffuser disposed on a first side in an axial direction with respect to the scroll casing and forming a flow path of the gas discharged from the impeller to the first side in the axial direction and swirling to the first side in the circumferential direction, and a vortex preventer provided in the diffuser, in which the vortex preventer includes a profile rectifying blade portion, which is curved or inclined to a second side in the circumferential direction from the first side toward a second side in the axial direction, at least in a portion of the second side in the axial direction.

5 Claims, 3 Drawing Sheets

GAS EXPANDER

BACKGROUND OF THE INVENTION

Field of the Invention

The present disclosure relates to a gas expander.

Priority is claimed on Japanese Patent Application No. 2021-024191, filed on Feb. 18, 2021, the content of which is incorporated herein by reference.

Description of Related Art

A device called a gas expander is known as a kind of rotating machine. The gas expander converts thermal energy of a working fluid having high temperature and high pressure into rotational energy by rotating an impeller and a rotating shaft with the working fluid.

In PCT International Publication No. WO2017/138035, a configuration is disclosed, which includes a diffuser having a flow path in which a gas expanded through an impeller (turbine wheel) flows in a rotational axis direction of the impeller, and a vortex prevention plate for partitioning the flow path of the diffuser in a circumferential direction.

The vortex prevention plate suppresses a vortex flow generated in the gas that has passed through the turbine wheel and reached the diffuser.

SUMMARY OF THE INVENTION

However, in the configuration described in PCT International Publication No. WO2017/138035, the vortex flow may not be sufficiently suppressed. Then, the vortex flow collides with the vortex prevention plate, and thus, a flow component reflected on the impeller side is generated, and a non-uniform flow velocity distribution occurs in the flow path in the diffuser. As a result, an exciting force acts on the impeller and the rotating shaft, which may cause vibration.

The present disclosure provides a gas expander capable of equalizing a flow velocity distribution of a gas flow in a flow path on a downstream side of an impeller and effectively suppressing the exciting force acting on the impeller and the rotating shaft.

According to an aspect of the present disclosure, there is provided a gas expander including: a scroll casing configured to send gas inside; an impeller accommodated in the scroll casing and configured to be rotationally driven to a first side in a circumferential direction around a central axis by the gas flowing while expanding from an outside to an inside in a radial direction; a diffuser disposed on a first side in an axial direction in which the central axis extends with respect to the scroll casing and forming a flow path of the gas discharged from the impeller to the first side in the axial direction and swirling to the first side in the circumferential direction; and a vortex preventer disposed in the diffuser, in which the impeller is configured to generate a vortex flow which swirls the gas discharged to the first side in the axial direction to the first side in the circumferential direction, and in which the vortex preventer includes a profile rectifying blade portion, which is curved or inclined to a second side in the circumferential direction from the first side toward a second side in the axial direction, at least in a portion of the second side in the axial direction.

According to the gas expander of the present disclosure, it is possible to equalize the flow velocity distribution of the gas flow in the flow path on the downstream side of the impeller and effectively suppressing the exciting force acting on the impeller and the rotating shaft.

DETAILED DESCRIPTION OF THE INVENTION

Hereinafter, a mode for carrying out the gas expander according to the present disclosure will be described with reference to the accompanying drawings. However, the present disclosure is not limited to embodiments.

(Configuration of Gas Expander)

Figure 1:
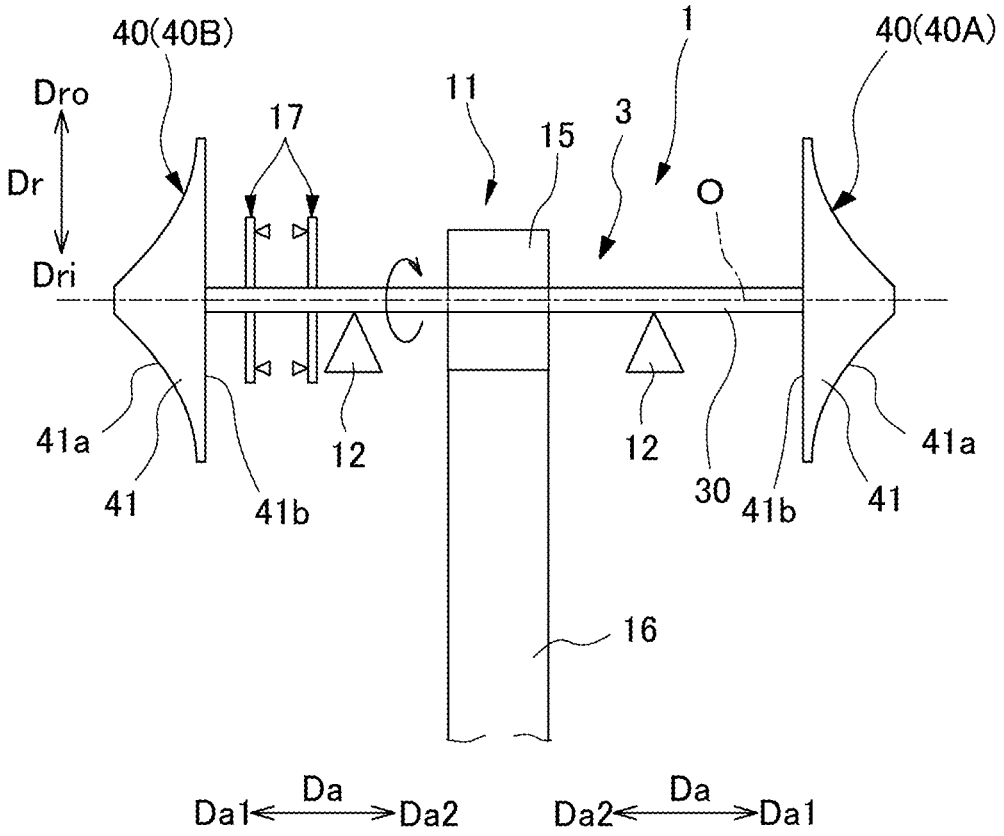
FIG. 1 is a diagram showing a schematic configuration of a gas expander according to an embodiment of the present disclosure.
Figure 2:
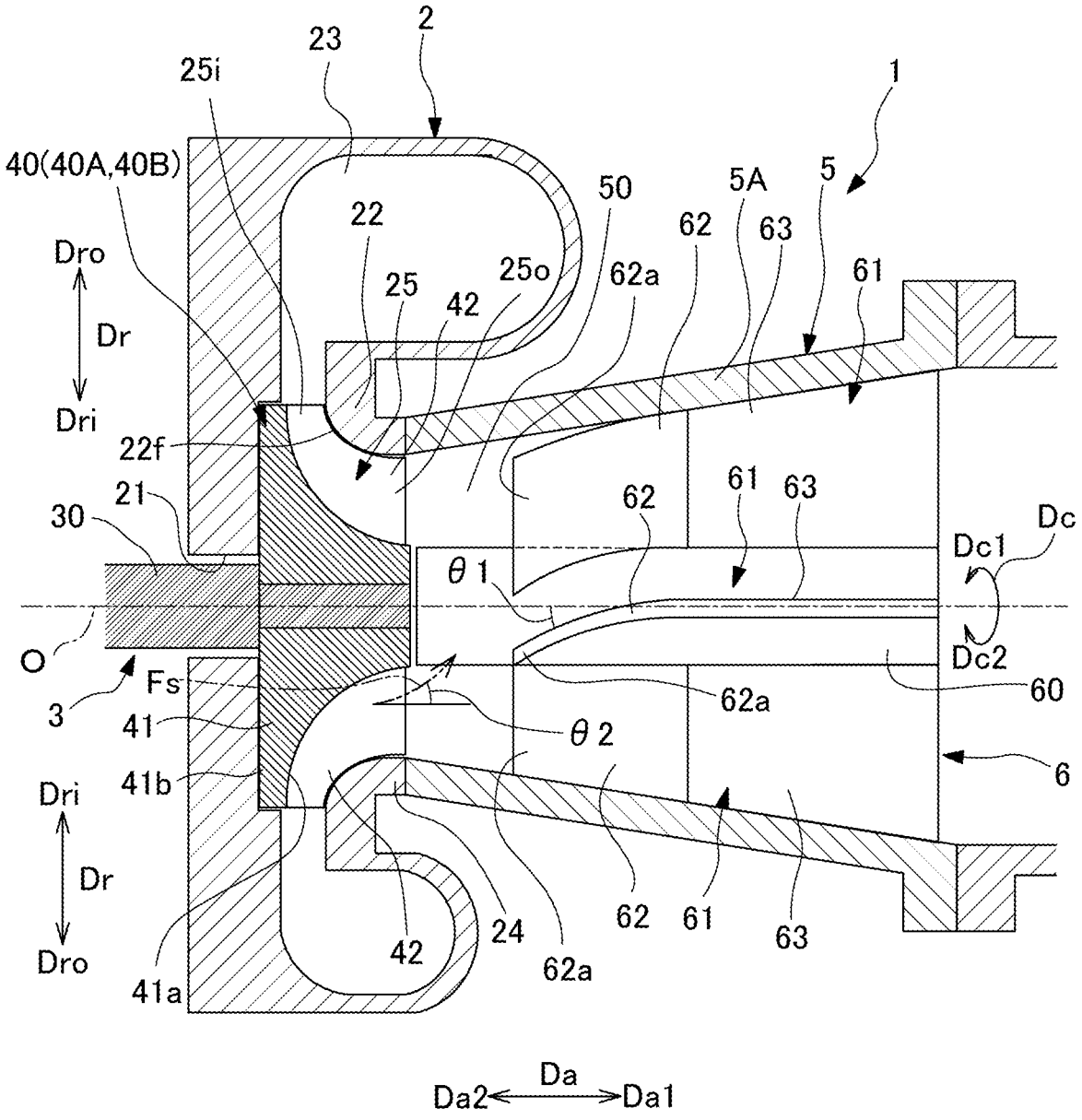
FIG. 2 is a cross-sectional view showing a scroll casing, an impeller, a diffuser, and a vortex preventer of the gas expander.

As shown in FIGS. 1 and 2, a gas expander 1 as a centrifugal rotating machine according to the present embodiment mainly includes a rotor 3, a scroll casing 2 (refer to FIG. 2), a diffuser 5, and a vortex preventer 6 (refer to FIG. 2).

(Rotor Configuration)

The rotor 3 includes a rotating shaft 30 and an impeller 40.

As shown in FIG. 1, the rotating shaft 30 extends in an axial direction Da. The rotating shaft 30 is rotatably supported around a central axis O by a pair of journal bearings 12. The pair of journal bearings 12 are disposed at distances in the axial direction Da. The rotating shaft 30 is restrained from moving in the axial direction Da by a pair of thrust bearings 17. The pair of thrust bearings 17 are disposed between a second-stage impeller 40B described below, and the journal bearing 12 on the second-stage impeller 40B side with respect to a pinion gear 15. The pair of thrust bearings 17 may be disposed at positions separated from each other on both sides in the axial direction Da with respect to the pinion gear 15.

The rotating shaft 30 is connected to an external drive target (not shown) via a deceleration transmission unit 11. The deceleration transmission unit 11 includes the pinion gear 15 and a bull gear 16.

The pinion gear 15 is fixed to the rotating shaft 30 between the pair of journal bearings 12. The bull gear 16 meshes with the pinion gear 15. The bull gear 16 rotationally drives the external drive target. The bull gear 16 has an outer diameter larger than that of the pinion gear 15. Therefore, a rotation speed of the bull gear 16 is lower than a rotation speed of the rotating shaft 30 having the pinion gear 15. The deceleration transmission unit 11 decelerates the rotation speed of the rotating shaft 30 via the pinion gear 15 and the bull gear 16 and transmits the decelerated rotation speed to the external drive target.

The impeller 40 is fixed to the rotating shaft 30. The gas expander 1 of the present embodiment includes the impellers 40 at both end portions of the rotating shaft 30 in the axial direction Da. As shown in FIG. 2, each impeller 40 of the present embodiment includes a disk 41 and a blade 42.

The disk 41 is formed in a disk shape and is fixed to the end portion of the rotating shaft 30. The disk 41 has a first surface 41*a* formed on one surface side of the axial direction Da and a second surface 41*b* formed on the other surface side of the axial direction Da. The second surface 41*b* of the disk 41 faces a side of the pinion gear 15 in the axial direction Da. The first surface 41*a* of the disk 41 faces a side opposite to the side of the pinion gear 15. That is, directions of the disks 41 of the first-stage impeller 40A provided at a first end of the rotating shaft 30 and the second-stage impeller 40B provided at a second end of the rotating shaft 30 are opposite to each other in the axial direction Da.

In the following description, in each impeller 40, a side facing the first surface 41*a* of the disk 41 is referred to as a first side Da1 in the axial direction Da, and a side facing the second surface 41*b* is referred to as a second side Da2 in the axial direction Da. For example, in the first-stage impeller 40A and the second-stage impeller 40B, the first side Da1 in the axial direction Da and the second side Da2 in the axial direction Da are opposite to each other.

As shown in FIG. 2, the first surface 41*a* of the disk 41 has a curved surface formed in a concave shape of which an outer diameter gradually expands from the first side Da1 to the second side Da2 in the axial direction Da. A gas, which is a working fluid, flows from an outside Dro toward an inside Dri in a radial direction Dr and from the second side Da2 (second surface 41*b* side) in the axial direction Da to the first side Da1 (first surface 41*a* side) in the axial direction Da, with respect to the disk 41 of the impeller 40.

The blade 42 is provided on the first surface 41*a* of the disk 41 facing the first side Da1 in the axial direction Da. A plurality of the blades 42 are disposed in a circumferential direction Dc around the central axis O.

(Configuration of Scroll Casing)

The scroll casing 2 is made of metal and is formed so as to cover the rotating shaft 30 and the impeller 40. The scroll casing 2 has a shaft labyrinth portion 21 through which the rotating shaft 30 is inserted. The scroll casing 2 includes an expansion portion 22, an gas supply flow path 23, and a discharge portion 24.

The expansion portion 22 is formed so as to cover the impeller 40. The expansion portion 22 has an impeller facing surface 22*f* formed at a distance on the first side Da1 in the axial direction Da with respect to the first surface 41*a* of the disk 41 of the impeller 40. The impeller facing surface 22*f* is continuously formed in the circumferential direction Dc so as to cover the plurality of blades 42.

An expansion flow path 25 is formed between the impeller facing surface 22*f* of the expansion portion 22 and the disk 41. The expansion flow path 25 has an inlet flow port 25*i* and an exhaust flow port 25*o*. The inlet flow port 25*i* opens toward the outside Dro of the impeller 40 in the radial direction Dr. The exhaust flow port 25*o* opens toward the first side Da1 in the axial direction Da on the inside Dri of the radial direction Dr of the first surface 41*a* side of the disk 41.

The gas supply flow path 23 is formed on the outside Dro in the radial direction Dr of the inlet flow port 25*i* of the expansion flow path 25. The gas supply flow path 23 has a spiral shape that is continuous in the circumferential direction Dc. A high-temperature and high-pressure gas sent from a turbine, a boiler, or the like outside the scroll casing 2 is supplied from the inlet flow port 25*i* to the expansion flow path 25 through the gas supply flow path 23.

The discharge portion 24 is open toward the first side Da1 in the axial direction Da. The discharge portion 24 defines the exhaust flow port 25*o* of the expansion flow path 25 on the inside Dri of the radial direction Dr. The discharge portion 24 discharges the gas discharged from the exhaust flow port 25*o* toward the first side Da1 in the axial direction Da.

According to the impeller 40 and the scroll casing 2 having the above configuration, the high-temperature and high-pressure gas sent from the turbine, boiler, or the like outside the scroll casing 2 is supplied from the inlet flow port 25*i* to the expansion flow path 25 through the gas supply flow path 23. While the gas supplied to the expansion flow path 25 expands in the process of flowing through the inside of the expansion flow path 25 from the outside Dro toward the inside Dri in the radial direction Dr, the gas rotationally drives the impeller 40 to a first side Dc1 in the circumferential direction Dc around the central axis O. The gas after being used for the rotation of the impeller 40 is discharged from the discharge portion 24 (exhaust flow port 25*o*) to the first side Da1 in the axial direction Da. In this case, the discharged gas includes a vortex flow Fs that is directed to the first side Da1 in the axial direction Da and swirls to the first side Dc1 in the circumferential direction Dc by the rotation around the central axis O of the impeller 40.

(Configuration of Diffuser)

The diffuser 5 mainly recovers a static pressure of the gas discharged from the discharge portion 24. The diffuser 5 is attached to the discharge portion 24 of the scroll casing 2. The diffuser 5 includes a diffuser main body 5A and the vortex preventer 6. The diffuser main body 5A has a tubular shape extending from the discharge portion 24 to the first side Da1 in the axial direction Da. The diffuser main body 5A forms a flow path 50 of gas discharged from the impeller 40 to the first side Da1 in the axial direction Da. The diffuser main body 5A is formed so that an inner diameter of the flow path 50 gradually increases from the second side Da2 toward the first side Da1 in the axial direction Da.

(Configuration of Vortex Preventer)

The vortex preventer 6 rectifies the vortex flow Fs by canceling a swirling component contained in the vortex flow Fs flowing through the flow path 50. The vortex preventer 6 is provided in the flow path 50, which is the internal space of the diffuser main body 5A. The vortex preventer 6 is disposed at a distance on the first side Da1 in the axial direction Da with respect to the impeller 40.

Figure 3:
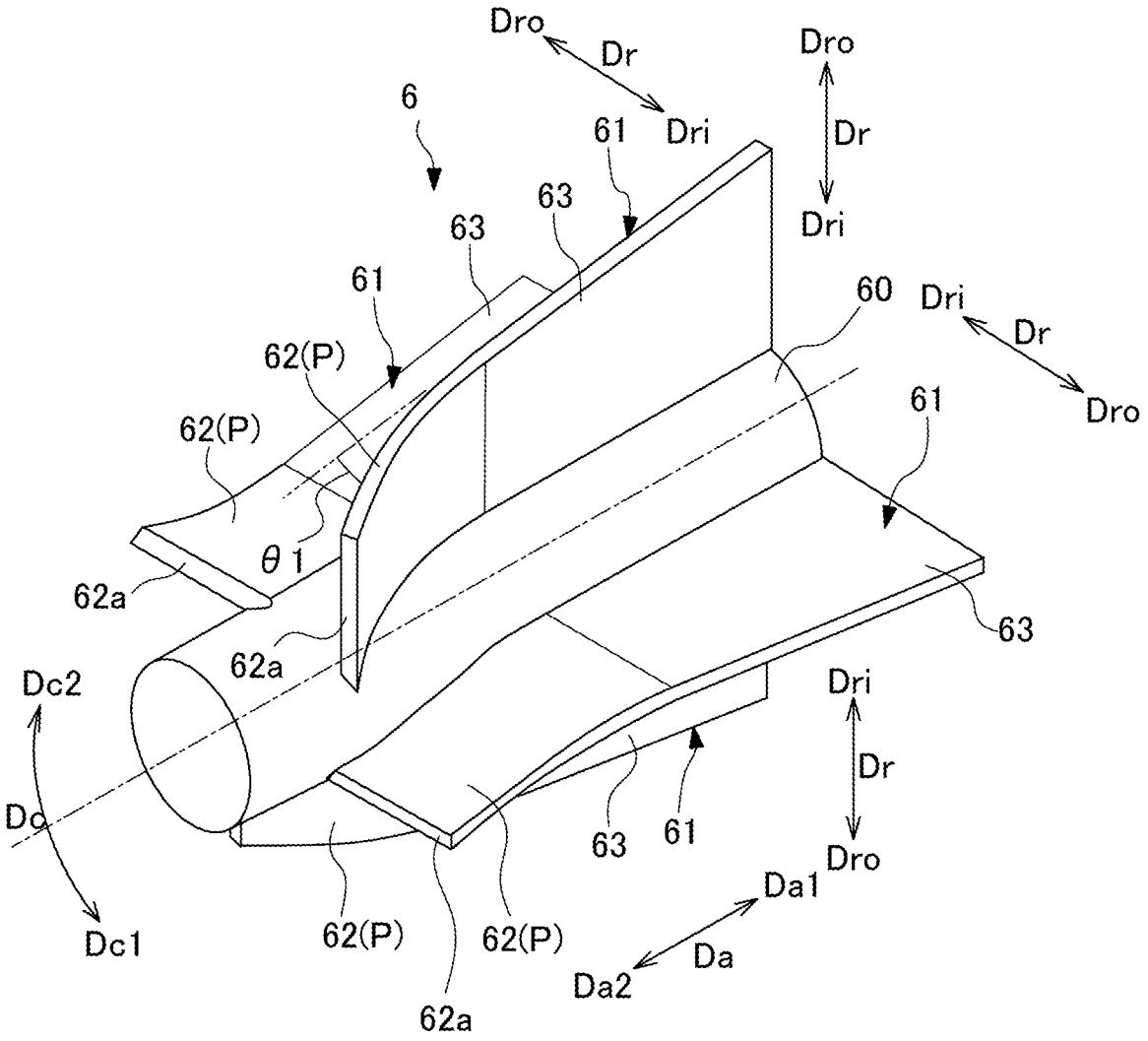
FIG. 3 is a perspective view of the vortex preventer.

As shown in FIGS. 2 and 3, the vortex preventer 6 includes a cylinder portion 60 and a plurality of rectifying blades 61. The cylinder portion 60 extends along the central axis O. The cylinder portion 60 has a circular cross section when viewed from the axial direction Da. The plurality of rectifying blades 61 are disposed on the outside Dr of the radial direction Dr of the cylinder portion 60 at distances in the circumferential direction Dc. In the present embodiment, a case where four rectifying blades 61 are provided at equal distances in the circumferential direction Dc is shown. The number of rectifying blades 61 is not limited in any way, and may be, for example, two, three, five or more.

Each rectifying blade 61 integrally includes a profile rectifying blade portion 62 and a plate rectifying blade portion 63. The profile rectifying blade portion 62 is formed on the second side Da2 in the axial direction Da with respect to the plate rectifying blade portion 63, that is, on a side closer to the impeller 40. The plate rectifying blade portion 63 is formed continuously on the first side Da1 in the axial direction Da with respect to the profile rectifying blade portion 62.

The plate rectifying blade portion 63 of the plurality of rectifying blades 61 is formed in a flat plate shape extending radially along the radial direction Dr from the cylinder portion 60 toward the outside Dro in the radial direction Dr. The plate rectifying blade portion 63 of each rectifying blade 61 formed in a flat plate shape overlaps the central axis O over the entire area of the axial direction Da when viewed from the outside Dro in the radial direction Dr.

The profile rectifying blade portion 62 is curved or inclined to be gradually positioned from the first side Da1 toward the second side Da2 in the axial direction Da and from a position of the plate rectifying blade portion 63 to the second side Dc2 in the circumferential direction Dc. In the present embodiment, a case is shown in which the profile rectifying blade portion 62 is curved to be positioned from the first side Da1 toward the second side Da2 in the axial direction Da and from a position of the plate rectifying blade portion 63 to the second side Dc2 in the circumferential direction Dc.

For example, the above-described profile rectifying blade portion 62 can be formed by bending a vortex preventer forming material P having a flat plate shape into a two-dimensional shape toward the second side Dc2 in the circumferential direction Dc from the first side Da1 toward the second side Da2 in the axial direction Da. When these profile rectifying blade portions 62 have a two-dimensional shape, when each profile rectifying blade portion 62 is viewed from the outside Dro in the radial direction Dr, positions in the circumferential direction Dc are the same at the same position in the axial direction Da. That is, the profile rectifying blade portion 62 curved into a two-dimensional shape is not formed so as to be twisted around the central axis O. The profile rectifying blade portion 62 of the present embodiment is formed in a shape of an arc in cross section formed with a constant radius of curvature.

It is also possible to add the profile rectifying blade portion 62 to the existing plate rectifying blade portion 63.

Preferably, an inclination angle θ1 of a blade leading edge portion 62*a* of the profile rectifying blade portion 62 on the second side Da2 (impeller 40 side) in the axial direction Da with respect to the central axis O is set based on a swirling angle of the vortex flow Fs of the gas discharged from the impeller 40. For example, when the gas flows at a maximum flow rate in the gas expander 1, the inclination angle θ1 may be equal to an inclination angle θ2 with respect to the axial direction Da of the vortex flow Fs discharged from the discharge portion 24 (exhaust flow port 25*o*). Here, since the profile rectifying blade portion 62 is curved in the present embodiment, the inclination angle θ1 is an angle between a tangent line at the blade leading edge portion 62*a* and the central axis O.

In the vortex preventer 6, the vortex flow Fs of the gas discharged from the impeller 40 to the first side Da1 in the axial direction Da flows along the blade leading edge portion 62*a* of the profile rectifying blade portion 62. Therefore, the vortex flow Fs does not collide violently with the vortex preventer 6 unlike in a case where an angle difference between the inclination angle θ1 at the blade leading edge portion 62*a* and the swirling angle of the vortex flow Fs is large. Then, the circumferential component of the vortex flow Fs is gradually reduced toward the first side Da1 by the profile rectifying blade portion 62. Further, the gas that has passed through the profile rectifying blade portion 62 flows along the plate rectifying blade portion 63, and thus, the gas flows along the axial direction Da toward the first side Da1 in the axial direction Da.

(Action Effect)

In the gas expander 1 having the above configuration, the vortex preventer 6 has a profile rectifying blade portion 62.

According to the configuration, the vortex flow Fs of the gas discharged from the impeller 40 to the first side Da1 in the axial direction Da is rectified by flowing along the profile rectifying blade portion 62. Since the profile rectifying blade portion 62 is curved or inclined from the first side Da1 toward the second side Da2 in the axial direction Da and to the second side Dc2 in the circumferential direction Dc, the vortex flow Fs of the gas smoothly flows along the profile rectifying blade portion 62. As a result, it is possible to suppress occurrence of turbulence in the gas flow in the flow path 50 on a downstream side of the impeller 40. In this way, a flow velocity distribution of the gas flow in the flow path 50 on the downstream side of the impeller 40 can be made uniform, and an exciting force acting on the impeller 40 and the rotating shaft 30 can be effectively suppressed.

Further, the vortex preventer 6 has the plate rectifying blade portion 63.

As a result, the gas flow through the profile rectifying blade portion 62 can be rectified so as to be directed toward the first side Da1 in the axial direction Da. Therefore, it is possible to suppress swirling of the vortex flow Fs of the gas swirling to the first side Dc1 in the circumferential direction Dc.

Further, the vortex preventer 6 is disposed at a distance in the axial direction Da with respect to the impeller 40.

As a result, a swirling speed of the vortex flow Fs is reduced before the gas discharged from the impeller 40 to the first side Da1 in the axial direction Da reaches the vortex preventer 6. Therefore, a rectifying effect of the vortex preventer 6 can be more effectively exerted, and the vortex flow Fs of the gas discharged from the impeller 40 to the first side Da1 in the axial direction Da can be effectively suppressed.

The profile rectifying blade portion 62 is formed by bending or inclining the vortex preventer forming material P having a flat plate shape into a two-dimensional shape.

Thereby, the profile rectifying blade portion 62 can be manufactured easily and at low cost.

Further, the diffuser 5 is formed so that the diameter dimension gradually increases from the second side Da2 toward the first side in the axial direction Da.

As a result, as the gas flows to the first side Da1 in the axial direction Da in the diffuser 5, the swirling speed of the vortex flow Fs discharged from the impeller 40 is reduced. Therefore, the rectifying effect of the vortex preventer 6 can be more effectively exerted, and the vortex flow Fs of the gas discharged from the impeller 40 to the first side Da1 in the axial direction Da can be effectively suppressed.

OTHER EMBODIMENTS

As described above, the embodiment of the present invention is described in detail with reference to the drawings. However, the specific configurations are not limited to the embodiment, and include a design modification or the like within a scope which does not depart from the gist of the present invention.

In the above embodiment, the profile rectifying blade portion 62 is curved in a two-dimensional shape. However, the present invention is not limited to this, and for example, the profile rectifying blade portion 62 may be curved in a three-dimensional shape.

Further, in the above embodiment, the impellers 40 are provided at both end portions of the rotating shaft 30 in the axial direction Da, but the present invention is not limited to this. The impeller 40 may be provided only on one side of the axial direction Da of the rotating shaft.

<Additional Notes>

The gas expander 1 described in the embodiment is ascertained as follows, for example.

(1) According to a first aspect, there is provided the gas expander 1 including: the scroll casing 2 configured to send gas inside; the impeller 40 accommodated in the scroll casing 2 and configured to be rotationally driven to the first side Dc1 in the circumferential direction Dc around the central axis O by the gas flowing while expanding from the outside Dro to an inside Dri in the radial direction Dr; the diffuser 5 disposed on the first side Da1 in the axial direction Da in which the central axis O extends with respect to the scroll casing 2 and forming the flow path 50 of the gas discharged from the impeller 40 to the first side Da1 in the axial direction Da and swirling to the first side Dc1 in the circumferential direction Dc; and the vortex preventer 6 disposed in the diffuser 5, in which the impeller 40 is configured to generate a vortex flow Fs which swirls the gas discharged to the first side D1 in the axial direction Da to the first side Dc1 in the circumferential direction Dc, and in which the vortex preventer 6 includes the profile rectifying blade portion 62, which is curved or inclined to the second side Dc2 in the circumferential direction Dc from the first side Da1 toward the second side Da2 in the axial direction Da, at least in a portion of the second side Da2 in the axial direction Da.

In the gas expander 1 having the configuration, the gas sent to the scroll casing 2 expands in the process of flowing from the outside Dro toward the inside Dri in the radial direction Dr of the impeller 40. The impeller 40 is rotationally driven to the first side Dc1 in the circumferential direction Dc by the flow of expanded gas. The gas discharged from the impeller 40 to the first side Da1 in the axial direction Da generates the vortex flow Fs that swirls toward the first side Dc1 in the circumferential direction Dc. The generated vortex flow Fs is rectified by flowing along the profile rectifying blade portion 62. Since the profile rectifying blade portion 62 is curved or inclined from the first side Da1 toward the second side Da2 in the axial direction Da and to the second side Dc2 in the circumferential direction Dc, the vortex flow Fs of the gas smoothly flows along the profile rectifying blade portion 62. As a result, it is possible to suppress the occurrence of turbulence in the gas flow in the flow path 50 on the downstream side of the impeller 40. In this way, the flow velocity distribution of the gas flow in the flow path 50 on the downstream side of the impeller 40 can be made uniform, and the exciting force acting on the impeller 40 and the rotating shaft 30 can be effectively suppressed.

(2) In the gas expander 1 according to a second aspect, in the gas expander 1 according to (1), the vortex preventer 6 further includes the plate rectifying blade portion 63 continuously formed to the first side Da1 in the axial direction Da from the profile rectifying blade portion 62 and having a flat plate shape extending in the axial direction Da.

As a result, the gas flow through the profile rectifying blade portion 62 can be rectified so as to be directed toward the first side Da1 in the axial direction Da. Therefore, it is possible to suppress the swirling of the vortex flow Fs of the gas swirling to the first side Dc1 in the circumferential direction Dc.

(3) In the gas expander 1 according to a third aspect, in the gas expander 1 according to (1) or (2), the vortex preventer 6 is disposed at a distance S in the axial direction Da with respect to the impeller 40.

As a result, the swirling speed of the vortex flow Fs is reduced before the gas discharged from the impeller 40 to the first side Da1 in the axial direction Da reaches the vortex preventer 6. Therefore, the rectifying effect of the vortex preventer 6 can be more effectively exerted, and the vortex flow Fs of the gas discharged from the impeller 40 to the first side Da1 in the axial direction Da can be effectively suppressed.

(4) In the gas expander 1 according to a fourth aspect, in the gas expander 1 according to any one of (1) to (3), the profile rectifying blade portion 62 is formed by bending or inclining the vortex preventer forming material P having a flat plate shape into a two-dimensional shape to the second side Dc2 in the circumferential direction Dc from the first side Da1 toward the second side Da2 in the axial direction Da.

As a result, the profile rectifying blade portion 62 can be manufactured easily and at low cost by bending or inclining the vortex preventer forming material P having a flat plate shape into a two-dimensional shape.

(5) In the gas expander 1 according to a fifth aspect, in the gas expander 1 according to any one of (1) to (4), the diffuser 5 is formed so that the inner diameter of the flow path 50 gradually increases from the second side Da2 toward the first side in the axial direction Da.

As a result, as the gas flows to the first side Da1 in the axial direction Da in the diffuser 5, the swirling speed of the vortex flow Fs discharged from the impeller 40 is reduced. Therefore, the rectifying effect of the vortex preventer 6 can be more effectively exerted, and the vortex flow Fs of the gas discharged from the impeller 40 to the first side Da1 in the axial direction Da can be effectively suppressed.

EXPLANATION OF REFERENCES

1: gas expander
2: scroll casing
3: rotor
5: diffuser
5A: diffuser main body
6: vortex preventer
11: deceleration transmission unit
12: journal bearing
15: pinion gear
16: bull gear
17: thrust bearing
21: shaft labyrinth portion
22: expansion portion
22*f*: impeller facing surface
23: gas supply flow path
24: discharge portion
25: expansion flow path
25*i*: inlet flow port
25*o*: exhaust flow port
30: rotating shaft
40: impeller
40A: first-stage impeller
40B: second-stage impeller
41: disk
41*a*: first surface
41*b*: second surface
42: blade
50: flow path
60: cylinder portion
61: rectifying blade
62: profile rectifying blade portion
62*a*: blade leading edge portion
63: plate rectifying blade portion
Da: axial direction
Da1: first side
Da2: second side
Dc: circumferential direction
Dc1: first side
Dc2: second side
Dr: radial direction Dri: inside
Dro: outside
Fs: vortex flow
O: central axis
P: vortex preventer forming material
θ1, θ2: inclination angle

What is claimed is:

1. A gas expander comprising:

a scroll casing configured to send gas inside;

an impeller accommodated in the scroll casing and configured to be rotationally driven to a first side in a circumferential direction around a central axis by the gas flowing while expanding from an outside to an inside in a radial direction;

a diffuser disposed on a first side in an axial direction in which the central axis extends with respect to the scroll casing and forming a flow path of the gas discharged from the impeller to the first side in the axial direction and swirling to the first side in the circumferential direction; and a vortex preventer disposed in the diffuser, wherein the impeller is configured to generate a vortex flow which swirls the gas discharged to the first side in the axial direction to the first side in the circumferential direction, the vortex preventer includes a profile rectifying blade portion, which is curved to a second side in the circumferential direction from the first side toward a second side in the axial direction, at least in a portion of the second side in the axial direction, and the profile rectifying blade portion has a surface that:

faces the second side in the circumferential direction so as to face the vortex flow, and is concavely curved when viewed in the radial direction.

2. The gas expander according to claim 1, wherein the vortex preventer further includes:

a cylinder portion extending along the central axis of the impeller; and a plate rectifying blade portion continuously formed to the first side in the axial direction from the profile rectifying blade portion and having a flat plate shape extending in the axial direction, the plate rectifying blade portion overlaps the cylinder portion over an entire length of the plate rectifying blade portion in the axial direction when viewed in the radial direction, and the profile rectifying blade portion is curved from a position of the plate rectifying blade portion in the circumferential direction toward the second side in the circumferential direction as the profile rectifying blade portion approaches the impeller from the plate rectifying blade portion in the axial direction.

3. The gas expander according to claim 1, wherein the vortex preventer is disposed at a distance in the axial direction with respect to the impeller.

4. The gas expander according to claim 1, wherein the profile rectifying blade portion is formed by bending a vortex preventer forming material having a flat plate shape into a two-dimensional shape to the second side in the circumferential direction from the first side toward the second side in the axial direction.

5. The gas expander according to claim 1, wherein the diffuser is formed so that an inner diameter of the flow path gradually increases from the second side toward the first side in the axial direction.

* * * * *